US005429678A

United States Patent [19]

Fany

[11] Patent Number: 5,429,678

[45] Date of Patent: Jul. 4, 1995

[54] SPONGE SQUEEGEE COMBINATION

[76] Inventor: Arthur J. Fany, 46 Postmans Track, Helensburgh, New South Wales, Australia, 2508

[21] Appl. No.: 244,727

[22] PCT Filed: Jan. 21, 1993

[86] PCT No.: PCT/AU93/00023

§ 371 Date: Jun. 8, 1994

§ 102(e) Date: Jun. 8, 1994

[87] PCT Pub. No.: WO93/14686

PCT Pub. Date: Aug. 5, 1993

[30] Foreign Application Priority Data

Jan. 23, 1992 [AU] Australia ..... PL0565

[51] Int. Cl.[6] ..... B08B 11/04; A47L 1/06; B60S 3/04

[52] U.S. Cl. ..... 134/6; 15/118; 15/121; 15/244.1; 15/244.3; 15/245

[58] Field of Search ..... 15/111, 117, 118, 121, 15/244.1, 245, 244.3, 244.4; 134/6

[56] References Cited

U.S. PATENT DOCUMENTS

| | | | |
|---|---|---|---|
| 2,116,645 | 5/1938 | Silverman | 15/244.1 |
| 2,678,458 | 5/1954 | Vosbikian et al. | 15/121 |
| 2,715,745 | 8/1955 | Jacobsen | 15/121 |
| 3,611,468 | 10/1971 | Michael | 15/118 |
| 3,748,684 | 7/1973 | Fraser | 15/244.1 |
| 3,857,133 | 12/1974 | Linenfelser . | |

FOREIGN PATENT DOCUMENTS

| | | |
|---|---|---|
| 223816 | 2/1958 | Australia . |
| 1115689 | 4/1956 | France . |
| 2541886 | 9/1984 | France . |
| 836238 | 6/1960 | United Kingdom . |
| 1417293 | 12/1975 | United Kingdom . |

*Primary Examiner*—Edward L. Roberts, Jr.
*Attorney, Agent, or Firm*—Smith-Hill and Bedell

[57] ABSTRACT

A car-cleaning implement (1) comprises a spongy resiliently-flexible liquid-absorbent block (2) having an exposed face (3) for applying soapy water, and its opposite face sheathed with a thin flexible skin (4) which is not water absorbent and is formed with parallel ribs (5) extending between opposite ends of the block. By inverting the block after washing off the soapy water, the ribbed skin can be used to remove water droplets from the painted surface of the car without streaking.

21 Claims, 3 Drawing Sheets

FIG. 1
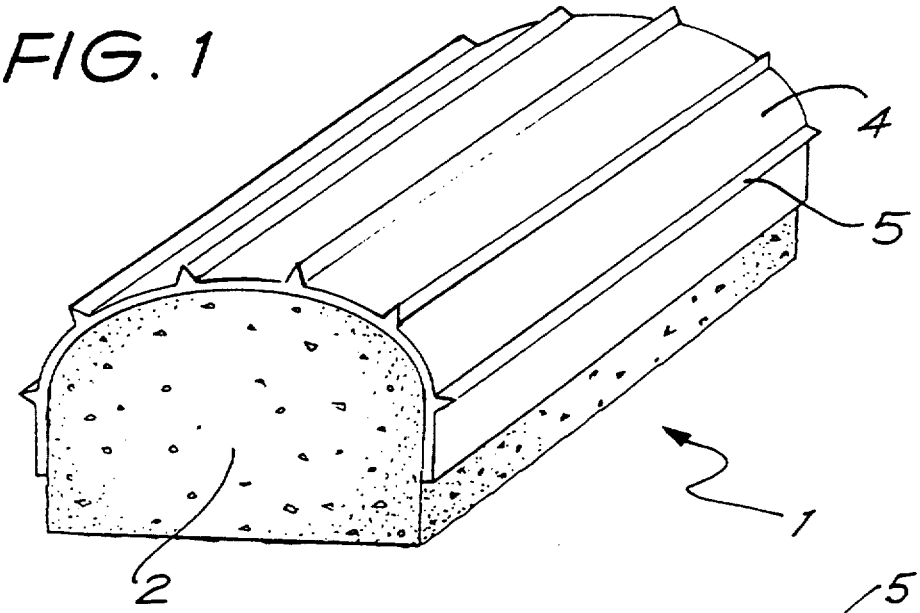
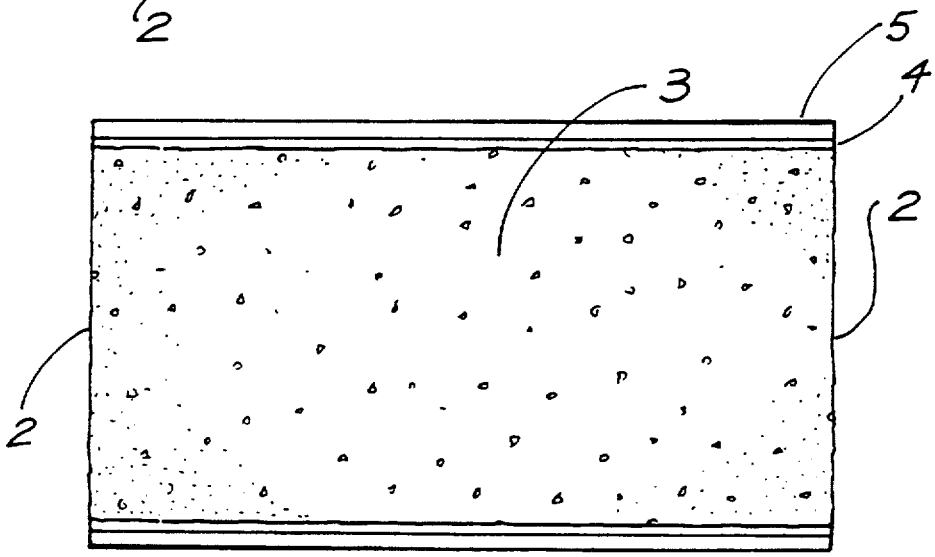
FIG. 2
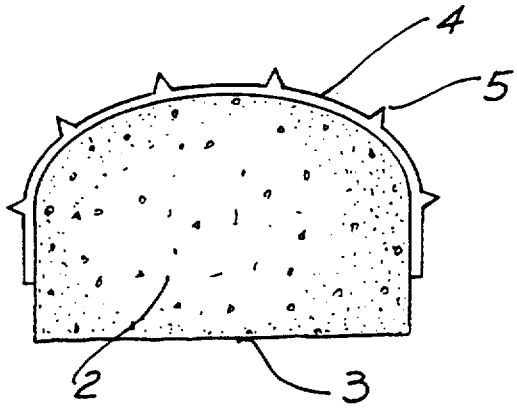
FIG. 3

SPONGE SQUEEGEE COMBINATION

FIELD OF THE INVENTION

THIS INVENTION relates to the washing of extended surfaces open to atmospheric pollution and grime, and is specifically, although not exclusively, concerned with hand-cleaning the paint-work of a motor vehicle.

STATE OF THE ART

The conventional way of cleaning the paint-work of a motor vehicle by hand, is to sponge down the paint-work with water, apply a cleaning agent such as a detergent or soap to the paint-work with a sponge and plenty of water, wash down the paint-work after cleaning with plenty of water usually supplied by a hose, and finally wiping residual spots of water from the paint work with a chamois leather which removes any free surface water from the paintwork.

OBJECTION OF THE INVENTION

An object of the invention is to provide an improved implement for cleaning an extended surface by hand.

SUMMARY OF THE INVENTION

According to the present invention an implement for cleaning grime from an extended surface susceptible to atmospheric pollution, comprises a resiliently-flexible block of relatively water-absorbent, spongy material having one face exposed for applying a cleaning solution such as soapy water to the surface to be cleaned, and the opposite face sheathed with a resiliently-flexible, externally-ribbed skin of material which is relatively non-absorbent to water.

The implement enables the cleaning solution to be hand-applied by way of the exposed face of the spongy block, and, after the cleaning solution has been washed off with clean water, residual drops of the water are removed by wiping the ribbed face of the block across the surface. The ribs on the face flex to conform to the contour of the surface beneath the block and act with a squeegee action to provide dams which remove water droplets from the area of the surface over which the ribbed face of the block is passed, so that the water droplets are removed and a clean and virtually drop-free surface emerges from beneath the block.

PREFERRED FEATURES OF THE INVENTION

In the preferred form of the invention the block has a flat rectangular face on one side, and its opposite side is of generally semi-cylindrical shape and is sheathed with the ribbed skin.

The ribs of the skin conveniently extend parallel to one another between opposite end-faces of the block so that they are wiped across the paint surface in a direction which is transverse to the direction in which the ribs extend. However, it is not essential for the ribs to be continuous. Experiments have shown that the implement works equally well where the ribs are interrupted or are of non-linear shape such as S-shape, or U-shape.

As one possible example of the shape of ribs which is useable it was found that ribs in the form of overlapping capital letters spelling out the name of the manufacturer and using the letters in staggered lines provided a satisfactory squeegee action. Whatever shape is chosen for the ribs, it is preferred that there is continuous band of the ribbed skin in contact with the paint surface when the water droplets are being wiped off, to prevent the droplets leaving streak-lines on the paint-work behind the implement.

Suitably the sheath covers the bulk of the generally semi-cylindrical shaped face of the sponge so that the sheath provides a hand-hold for the block and prevents liquid absorbed into the spong from flooding out over the hand of the user when the cleaning solution is being applied. The semi-cylindrical shape of the block facilitates the ability of the block to perform a partly wiping action and partly rolling action, as the user's wrist turns naturally during the wiping movement of the block over the surface being cleaned.

INTRODUCTION TO THE DRAWINGS

The invention will now be described in more detail, by way of examples, with reference to the accompanying partly diagrammatic drawings, in which:

FIG. 1 is a top perspective view of a spongy implement for cleaning a painted surface;

FIG. 2 is an under plan view of the implement;

FIG. 3 is an end view of the implement, both ends appearing the same;

DESCRIPTION OF PREFERRED EMBODIMENT

Figure 4:
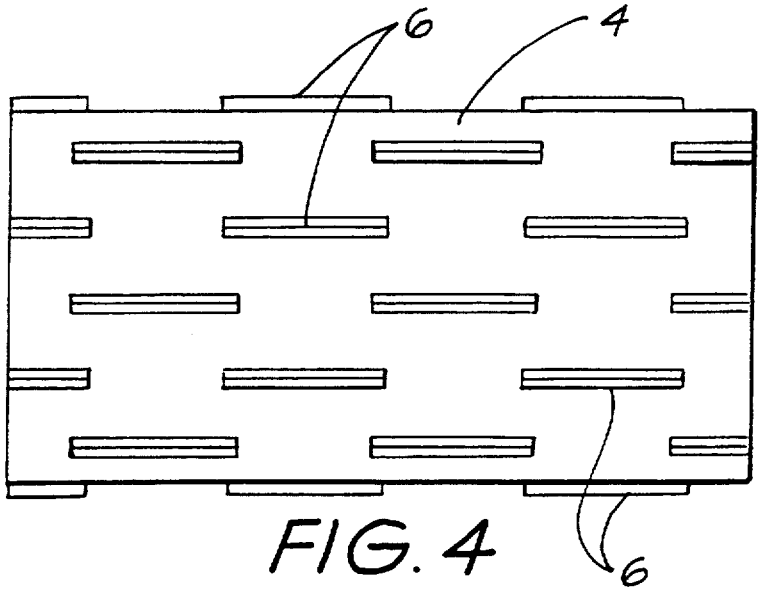
FIG. 4 is a top plan view showing a further design of ribbing on the sheath.

FIG. 1 shows a cleaning implement 1 which is about 215 mm. long, 105 mm. wide and 75 mm. high. It comprises a soft, resiliently flexible, sponge block which is water absorbent and which has a flat rectangular face 3 shown in FIG. 2. The opposite face of the block is a generally semi-cylindrical shape to provide a comfortable hand-hold, and is sheathed with a non-absorbent resiliently flexible skin 4 which is 2 mm. thick. The skin 4 is provided with external parallel ribs 5 about 2 mm. high and which have a V-shaped section as shown in FIG. 3. the block is made from an open-cell foam of soft polyurethane, and the skin 4 is made form closed-cell ethylene vinyl acetate foam.

The skin is cemented to the block by a waterproof adhesive which when applied, does not degrade the skin 4 or the surface of the block 2.

VARIATIONS OF PREFERRED EMBODIMENT

Figure 5:
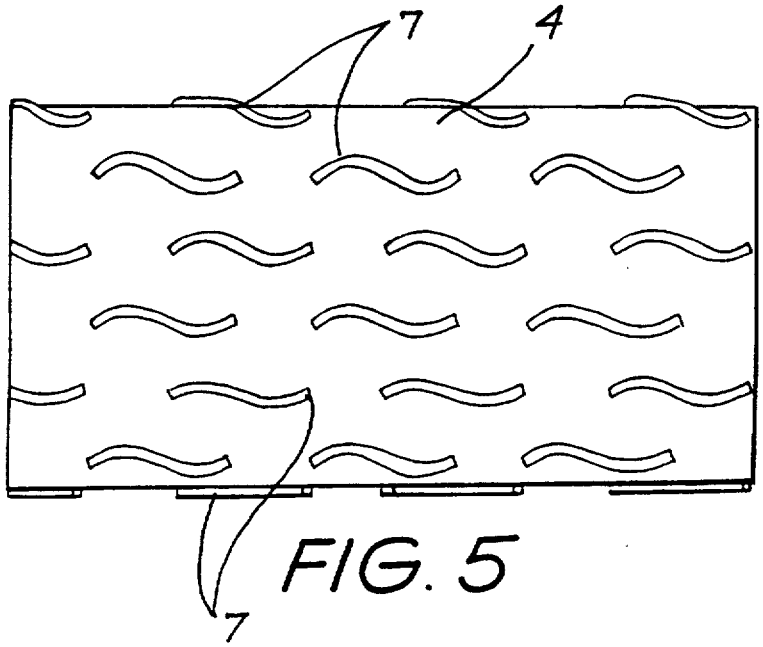
FIG. 5 is a top plan view of an implement with yet another shape of ribbing on the sheath.

As appears from FIGS. 4 and 5 the ribs 5 provided on the skin 4 can have different shapes without detracting from the usefulness of the invention.

In FIG. 4 the ribs are interrupted to provide short rib sections 6 which are staggered with respect to the lines of short rib sections in the adjacent rib lines.

In FIG. 5 the ribs are formed by S-shape rib sections 7 arranged in lines and staggered with respect to the ribs in neighbouring lines.

In a further embodiment (not shown) the rib sections are of C-shape with successive rib sections in each line facing in opposite directions respectively, and the rib sections in adjacent lines being staggered with respect to one another.

In another non-illustrated embodiment, the block 2 is of parallelepiped shape and has one rectangular face exposed, and the other, opposite, rectangular face and adjacent portions of the longer sides of the block sheathed with the skin which effectively provides two parallel ribs where it extends over the corners at the longer sides of said opposite face. The end faces of the block may also be sheathed with the skin if desired.

USE OF THE IMPLEMENT

Figure 6:
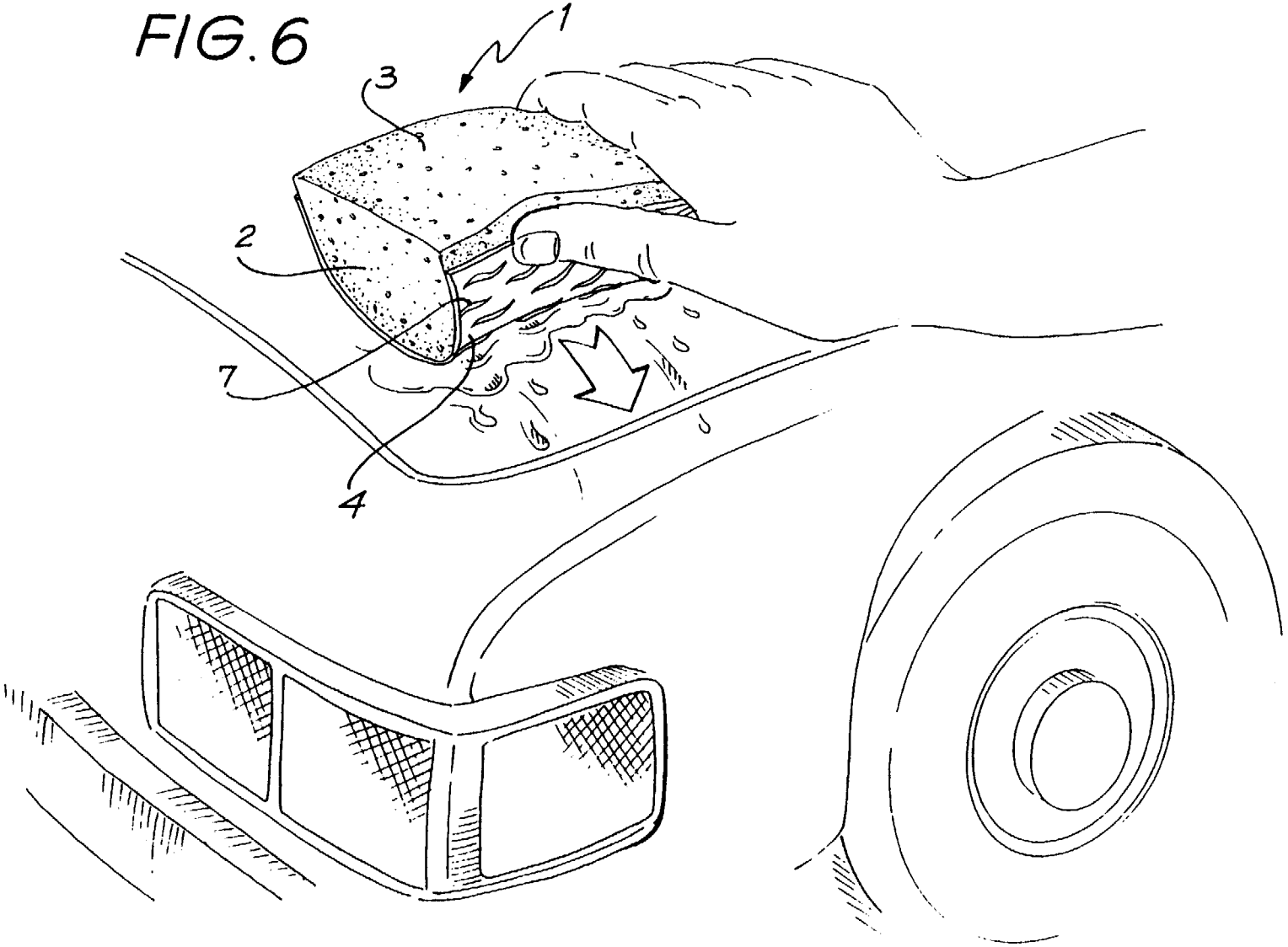
FIG. 6 shows the implement of FIG. 5 in use wiping surplus water drops from the painted surface of part of a motor vehicle.

FIG. 6 shows the implement in use to remove water droplets from the painted surface of a motor vehicle body. The vehicle body has a curved contour but the flexibility of the implement enables it to mould itself naturally to the painted surface under hand pressure, so that the ribs provide dams which prevent the water droplets from passing beneath the skin 4 of the implement as it is passed over the wet curved painted surface of the vehicle. The painted surface is thus wiped dry in much the same way as if the water droplets had been removed by a chamois leather using the conventional technique.

I claim:

1. An implement for cleaning grime and wiping liquid from an extended surface, comprising a resiliently-flexible block of relatively water-absorbent spongy material having one face exposed for applying a cleaning solution, such as soapy water, to the surface to be cleaned and wiped dry, and the opposite face sheathed with a relatively thin resiliently-flexible skin of material which is non-absorbent to water and which is bonded over substantially its entire area to said opposite face so as to be effectively integral therewith and said resiliently-flexible skin having non-absorbent V-shaped ridges with smooth outer edges formed on its outer side to act as effective wiping blades that can bend in three dimensions and wipe liquid from a curved surface.

2. An implement as claimed in claim 1, in which the ridges are spaced and substantially parallel and extended in continuous fashion between opposite ends of the block.

3. An implement as claimed in claim 1, in which the ridges are each formed from spaced ridge sections which are staggered with respect to the ridge sections of the neighboring ridges.

4. An implement as claimed in claim 1, in which the exposed face of the block is rectangular, and said skin provides a semi-cylindrical hand-hold for the implement.

5. An implement as claimed in claim 1, in which the block is made from soft foam and the skin is made from a closed cell layer integrally formed with the ridges.

6. An implement as claimed in claim 5, in which the material of the block is polyurethane and the material of the skin is ethylene vinyl acetate or polyethylene.

7. An implement as claimed in claim 6, in which the ridges are heat formed onto the skin.

8. An implement as claimed in claim 1, in which the ridges are formed in a random pattern.

9. An implement as claimed in claim 1, in which the ridges are formed in a non-random pattern.

10. An implement as claimed in claim 1, in which the ridges form letters.

11. An implement as claimed in claim 1, in which the ridges form writing symbols.

12. An implement as claimed in claim 1, wherein the outer edges of the V-shaped ridges are relatively sharp.

13. An implement as claimed in claim 1, wherein each of the V-shaped ridges has two lateral surfaces that converge toward the top of the ridge.

14. An implement as claimed in claim 1, wherein the block has two lateral faces that join the exposed face to said opposite face and the resiliently-flexible skin wraps around the lateral faces of the block from said opposite face toward the exposed face and covers a substantial proportion of the area of the lateral faces.

15. An implement as claimed in claim 1, wherein the implement is devoid of metal projections that can engage the extended surface when the implement is in use.

16. An implement as claimed in claim 1, wherein the implement is completely non-metallic.

17. An implement for cleaning grime and wiping liquid from an extended surface, consisting of a resiliently-flexible block of relatively water-absorbent spongy material having one face exposed for applying a cleaning solution, such as soapy water, to the surface to be cleaned and wiped dry, and the opposite face sheathed with a relatively thin resiliently-flexible skin of material which is non-absorbent to water and which is bonded over substantially its entire area to said opposite face so as to be effectively integral therewith and said resiliently-flexible skin having non-absorbent V-shaped ridges with smooth outer edges formed on its outer side to act as effective wiping blades that can bend in three dimensions and wipe liquid from a curved surface.

18. An implement as claimed in claim 17, in which the exposed face of the block is rectangular, and said skin provides a semi-cylindrical hand-hold for the implement.

19. An implement as claimed in claim 17, in which the block is made from soft foam and the skin is made from a closed cell layer integrally formed with the ridges.

20. An implement as claimed in claim 19, in which the material of the block is polyurethane and the material of the skin is ethylene vinyl acetate or polyethylene.

21. A method of cleaning grime and wiping liquid from an extended surface, comprising:

providing an implement consisting of a resiliently-flexible block of relatively water-absorbent spongy material having one face exposed and the opposite face sheathed with a relatively thin resiliently-flexible skin of material which is non-absorbent to water and which is bonded over substantially its entire area to said opposite face so as to be effectively integral therewith and said resiliently-flexible skin having non-absorbent V-shaped ridges with smooth outer edges formed on its outer side to act as effective wiping blades that can bend in three dimensions, gripping the implement in the hand with the resiliently-flexible skin toward the palm of the hand and applying a cleaning solution, such as soapy water, to the surface to be cleaned and wiped dry, and gripping the implement in the hand with the exposed face of the block toward the palm of the hand and wiping the surface with the resiliently-flexible skin, whereby the wiping blades wipe liquid from the surface.

* * * * *